US010892552B2

(12) United States Patent
Hsu et al.

(10) Patent No.: US 10,892,552 B2
(45) Date of Patent: Jan. 12, 2021

(54) ANTENNA STRUCTURE

(71) Applicant: Chiun Mai Communication Systems, Inc., New Taipei (TW)

(72) Inventors: Cho-Kang Hsu, New Taipei (TW); Min-Hui Ho, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 16/427,565

(22) Filed: May 31, 2019

(65) Prior Publication Data

US 2019/0372223 A1 Dec. 5, 2019

(30) Foreign Application Priority Data

Jun. 1, 2018 (CN) ..... 2018 1 0558769

(51) Int. Cl.

| | |
|---|---|
| ***H01Q 1/24*** | (2006.01) |
| ***H01Q 5/30*** | (2015.01) |
| ***H01Q 5/335*** | (2015.01) |
| ***H01Q 1/48*** | (2006.01) |
| ***H01Q 13/18*** | (2006.01) |
| ***H01Q 5/321*** | (2015.01) |

(52) U.S. Cl.

CPC ..... *H01Q 5/335* (2015.01); *H01Q 1/241* (2013.01); *H01Q 1/242* (2013.01); *H01Q 1/243* (2013.01); *H01Q 1/48* (2013.01); *H01Q 5/321* (2015.01); *H01Q 13/18* (2013.01)

(58) Field of Classification Search

CPC ..... H01Q 1/243; H01Q 5/335; H01Q 5/30; H01Q 5/314; H01Q 9/0421; H01Q 9/065; H01Q 9/14; H01Q 13/106; H01Q 1/521; H01Q 21/30; H01Q 3/247; H01Q 5/321; H01Q 5/385; H01Q 5/50; H01Q 1/24; H01Q 1/241; H01Q 1/242

See application file for complete search history.

(56) References Cited

U.S. PATENT DOCUMENTS 6,549,169 B1 * 4/2003 Matsuyoshi ..... H01Q 1/243 343/702
7,671,815 B2 * 3/2010 Thornell-Pers ..... H01Q 1/243 343/722

(Continued)

FOREIGN PATENT DOCUMENTS

CN 105655705 A 6/2016
CN 205543232 U 8/2016

(Continued)

*Primary Examiner* — Vibol Tan
(74) *Attorney, Agent, or Firm* — ScienBiziP, P.C.

(57) ABSTRACT

An antenna structure includes a housing and at least one switching circuit. The housing includes a border frame made of metal including at least one gap dividing the border frame into at least two radiating portions. The at least one switching circuit is mounted to the at least one gap and electrically coupled to the at least two radiating portions on opposite sides of the at least one switching circuit. The at least one switching circuit is controlled to switch between an open circuit state and a closed circuit state. A length of the at least two radiating portions is changed by the at least one switching circuit switched between the open circuit state and the closed circuit state to adjust a bandwidth of the antenna structure.

20 Claims, 15 Drawing Sheets

(56) References Cited

U.S. PATENT DOCUMENTS

| | | | | |
|---|---|---|---|---|
| 7,808,433 | B2 * | 10/2010 | Rutfors | H01Q 9/145 343/700 MS |
| 9,673,512 | B2 * | 6/2017 | Lin | H01Q 9/42 |
| 9,680,222 | B2 * | 6/2017 | Lin | H01Q 5/328 |
| 9,748,638 | B2 * | 8/2017 | Wei | H01Q 21/30 |
| 10,020,562 | B2 * | 7/2018 | Lee | H01Q 5/371 |
| 10,122,084 | B2 * | 11/2018 | Hu | H01Q 3/247 |
| 10,211,536 | B2 * | 2/2019 | Liang | H01Q 3/24 |
| 10,340,581 | B2 * | 7/2019 | Lee | H01Q 1/44 |
| 2013/0154897 | A1 | 6/2013 | Sorensen et al. | |
| 2017/0048363 | A1 | 2/2017 | Lee et al. | |
| 2018/0248260 | A1 * | 8/2018 | Hu | H01Q 1/244 |
| 2019/0181553 | A1 * | 6/2019 | Lee | H01Q 21/28 |
| 2019/0181554 | A1 * | 6/2019 | Lee | H01Q 5/335 |
| 2019/0181555 | A1 * | 6/2019 | Lee | H01Q 1/243 |
| 2019/0260114 | A1 * | 8/2019 | Hu | H01Q 3/24 |

FOREIGN PATENT DOCUMENTS

| | | | | |
|---|---|---|---|---|
| CN | 106450662 | A | 2/2017 | |
| CN | 106935959 | A | 7/2017 | |
| WO | WO-2017157336 | A1 * | 9/2017 | H05K 5/04 |

* cited by examiner

ANTENNA STRUCTURE

FIELD

The subject matter herein generally relates to antenna structures, and more particularly to an antenna structure of a wireless communication device.

BACKGROUND

As electronic devices become smaller, an antenna structure for operating in different communication bands is required to be smaller.

BRIEF DESCRIPTION OF THE DRAWINGS

Implementations of the present disclosure will now be described, by way of example only, with reference to the attached figures.

DETAILED DESCRIPTION

Figure 1:
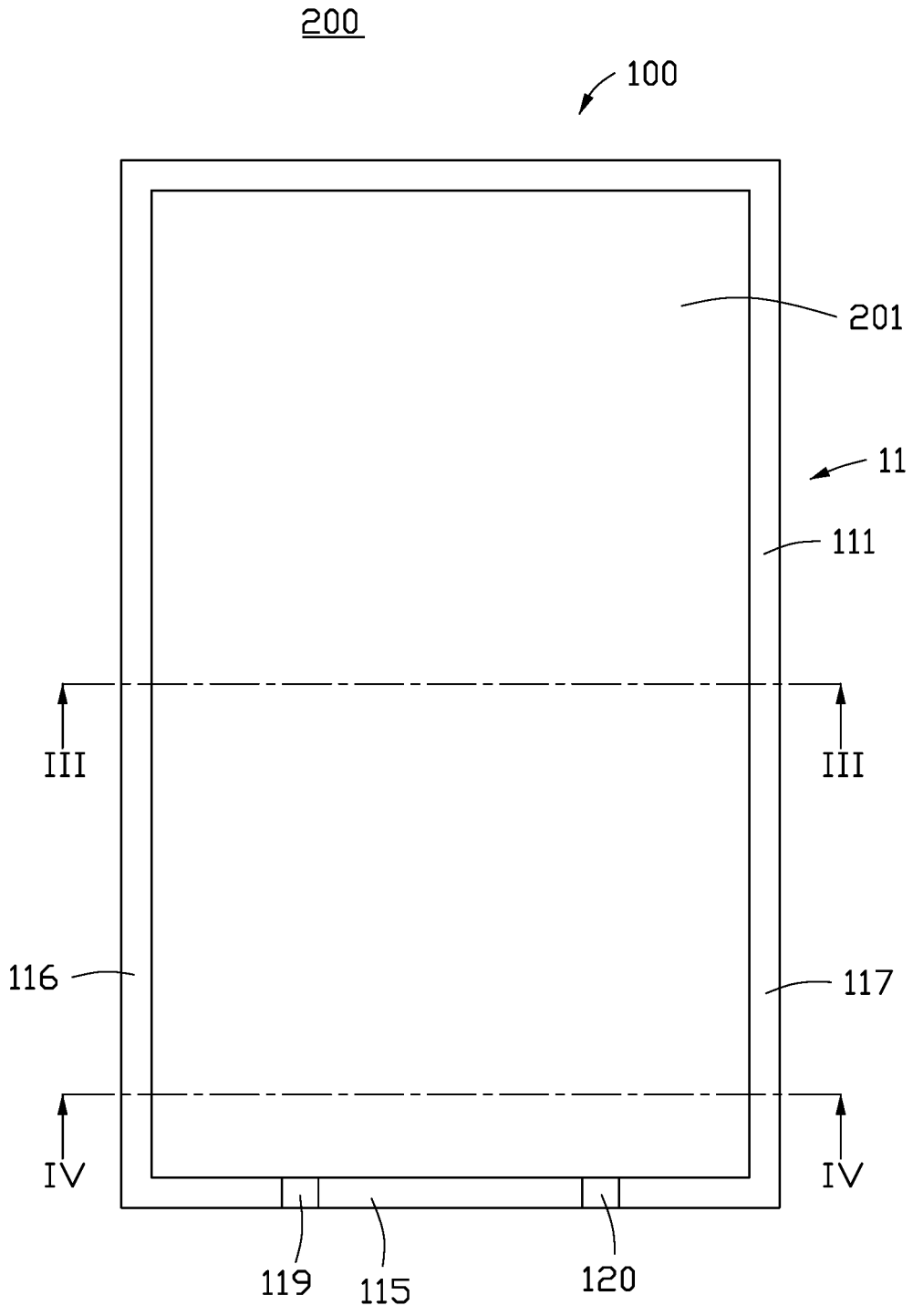
FIG. 1 is a diagram of an embodiment of a wireless communication device including an antenna structure.
Figure 2:
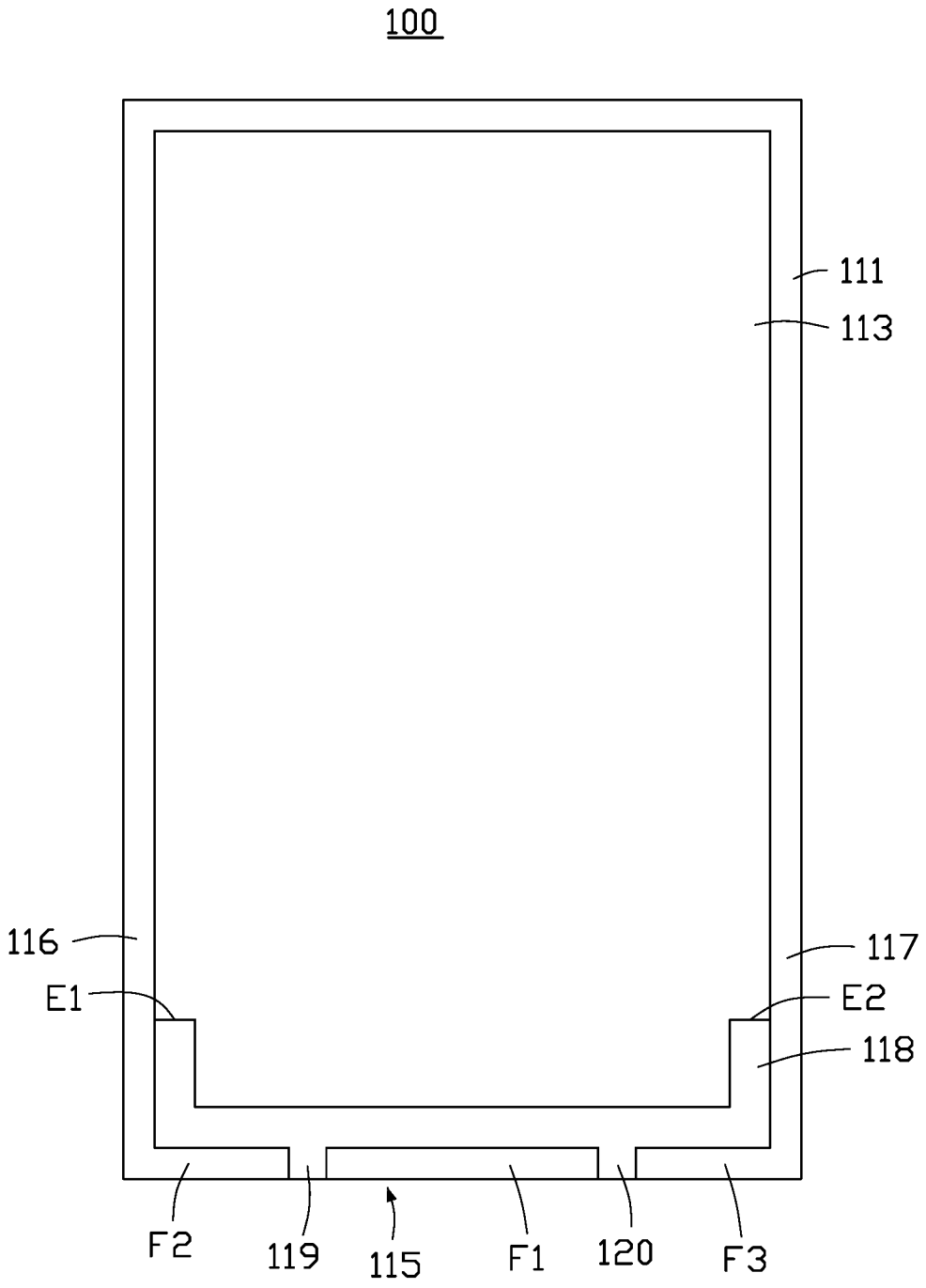
FIG. 2 is a diagram of internal components of the wireless communication device in FIG. 1.
Figure 3:
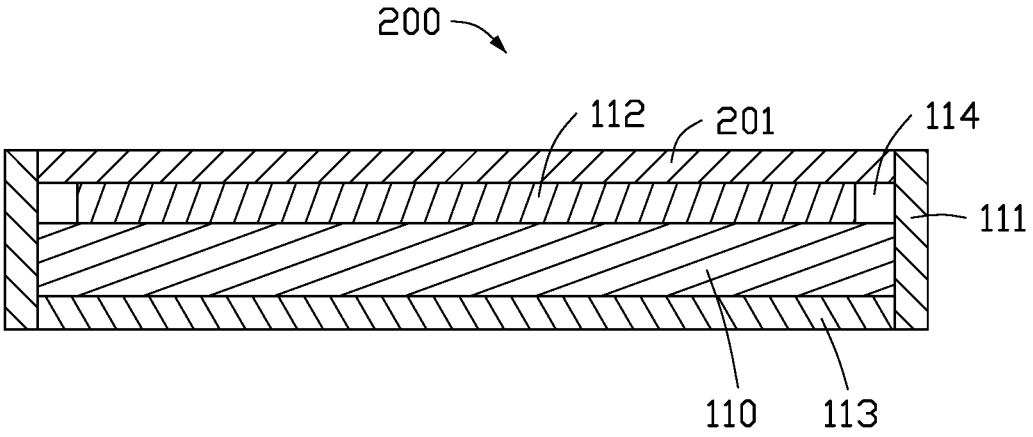
FIG. 3 is a cross-sectional view of the antenna structure taken along line III-III in FIG. 1.
Figure 4:
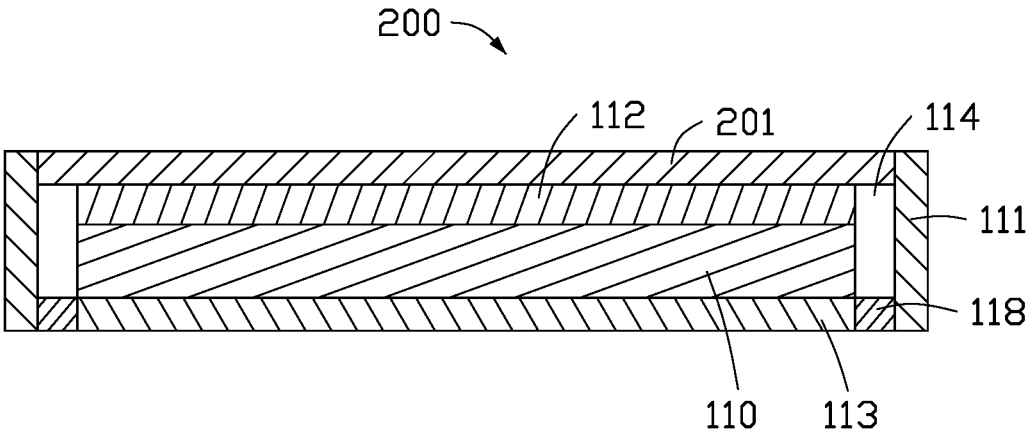
FIG. 4 is a cross-sectional view of the antenna structure taken along line IV-IV in FIG. 1.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

FIGS. 1-4 show an embodiment of an antenna structure 100 applicable in a mobile phone, a personal digital assistant, or other wireless communication device 200 for transmitting and receiving wireless signals.

The antenna structure 100 includes a housing 11, a first feed portion 12 (shown in FIG. 5), and at least one switching circuit. The housing 11 includes at least a system ground surface 110, a border frame 111, a middle frame 112, and a back cover 113. The system ground surface 110 is made of metal or other conductive material for grounding the antenna structure 100.

The border frame 111 is substantially hollow rectangular and is made of metal or other conductive material. The border frame 111 is mounted around a periphery of the system ground surface 110. In one embodiment, an edge of one side of the border frame 111 is spaced from the system ground surface 110 to define a clearance area 114 (shown in FIGS. 3 and 4). In one embodiment, a distance between the border frame 111 and the system ground surface 110 may be adjusted according to requirements. In one embodiment, the distance between the border frame 111 and the system ground surface 110 may be the same at different points of the border frame or different at different points of the border frame.

The middle frame 112 is substantially rectangular and is made of metal or other conductive material. A size of the middle frame 112 is less than a size of the system ground surface 110. The middle frame 112 is layered over the system ground surface 110.

In one embodiment, the border frame 111 defines an opening (not shown) in one side adjacent to the middle frame 112 for receiving a display 201 of the wireless communication device 200. The display 200 is exposed through the opening.

The back cover 113 is made of metal or other conductive material. The back cover 113 is mounted around a periphery of the border frame 111. In one embodiment, the back cover 113 is mounted to a side of the system ground surface 110 opposite from the middle frame 112 and is substantially parallel to the display 201 and the middle frame 112.

In one embodiment, the system ground surface 110, the border frame 111, the middle frame 112, and the back cover 113 are integrally formed. The middle frame 112 is a metal plate located between the display 201 and the system ground surface 110. The middle frame 112 supports the display 201, provides electromagnetic shielding, and enhances durability of the wireless communication device 200.

In one embodiment, the border frame 111 includes at least an end portion 115, a first side portion 116, and a second side portion 117. The end portion 115 may be a bottom end of the wireless communication device 200. The first side portion 116 and the second side portion 117 face each other and are respectively coupled to opposite ends of the end portion 115 and are substantially perpendicular to the end portion 115.

The housing 11 includes a slot 118 and at least one gap. The slot 118 is defined in the back cover 113. The slot 118 is substantially U-shaped and is defined in the back cover 113 adjacent to the end portion 115. The slot 118 extends toward the first side portion 116 and the second side portion 117. In one embodiment, the housing 11 defines a first gap 119 and a second gap 120. Each of the first gap 119 and the second gap 120 is defined in the end portion 115. The first gap 119 and the second gap 120 partition the border frame 111 and are each coupled to the slot 118.

The first gap 119 and the second gap 120 cut across and cut through the end portion 115. The slot 118, the first gap 119, and the second gap 120 cooperatively divide the housing 11 into a first radiating portion F1, a second radiating portion F2, and a third radiating portion F3. In one embodiment, a portion of the border frame 111 between the first gap 119 and the second gap 120 is the first radiating portion F1. A portion of the border frame 111 between the first gap 119 and an endpoint E1 of the first side portion 116 is the second radiating portion F2. A portion of the border frame 111 between the second gap 120 and an endpoint E2 of the second side portion 117 is the third radiating portion F3. In one embodiment, the first radiating portion F1 is spaced from and insulated from the middle frame 112. Each of an end of the second radiating portion F2 adjacent to the endpoint E1 and an end of the third radiating portion F3 adjacent to the endpoint E2 is coupled to the system ground surface 110, and the back cover 113 and are coupled to ground.

In one embodiment, a width of the slot 118 is less than or equal to twice a width of the first gap 119 and a width of the second gap 120. The width of the slot 118 is 0.5-2 mm, and each of the width of the first gap 119 and the width of the second gap 120 is 1-2 mm.

The slot 118, the first gap 119, and the second gap 120 are filled with insulating material, such as plastic, rubber, glass, wood, or ceramic.

Figure 5:
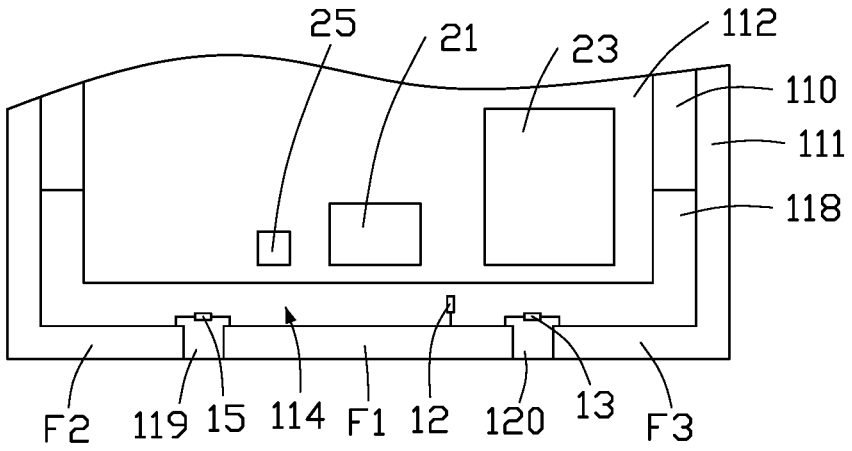
FIG. 5 is a partial view of the antenna structure in FIG. 1.

As shown in FIG. 5, the wireless communication device 200 further includes at least one electronic component, such as a first electronic component 21, a second electronic component 23, and a third electronic component 25. The first electronic component 21 may be a universal serial bus (USB) connecting port. The first electronic component 21 is mounted in the middle frame 112 adjacent to an edge of the first radiating portion F1 and is insulated from the first radiating portion F1 by the slot 118. The second electronic component 23 may be a speaker mounted in the middle frame 112 adjacent to a side of the first radiating portion F1 and mounted correspondingly to the second gap 120. In one embodiment, the second electronic component 23 is spaced 2-10 mm from the slot 118. The third electronic component 25 may be a microphone mounted in the middle frame 112 adjacent to an edge of the first radiating portion F1. The third electronic component 25 is mounted on a side of the first electronic component 21 away from the second electronic component 23 and is adjacent to the first gap 119. In one embodiment, the second electronic component 23 and the third electronic component 25 are insulated from the first radiating portion F1 by the slot 118.

In other embodiment, the second electronic component 23 and the third electronic component 25 may be mounted in different locations according to requirements.

In one embodiment, the first feed portion 12 is mounted in the clearance area 114 between the system ground surface 110 and the border frame 111. One end of the first feed portion 12 is electrically coupled to a signal feed point (not shown) of the system ground surface 110 by a clip, a microgap, a gap, a coaxial cable, or other connection means. A second end of the first feed portion 12 is electrically coupled through a matching circuit (not shown) to a side of the first radiating portion F1 adjacent to the second gap 120 for feeding an electric current to the first radiating portion F1, the second radiating portion F2, and the third radiating portion F3.

In one embodiment, the first feed portion 12 is formed by laser direct structuring (LDS) iron, metal cladding, or other conductive material.

In one embodiment, the antenna structure 100 includes a switching circuit 13 and a switching circuit 15. The switching circuit 13 is mounted to the second gap 120, and the switching circuit 15 is mounted to the first gap 119. One end of the switching circuit 13 is electrically coupled to the first radiating portion F1, and a second end of the switching circuit 13 is electrically coupled to the third radiating portion F3. One end of the switching circuit 15 is electrically coupled to the first radiating portion F1, and a second end of the switching circuit 15 is electrically coupled to the second radiating portion F2.

In one embodiment, the switching circuit 13 and the switching circuit 15 are controlled to switch between an open circuit state and a closed circuit state to electrically coupled the first radiating portion F1, the second radiating portion F2, and the third radiating portion F3, thereby adjusting a frequency of the antenna structure 100.

Figure 6A:
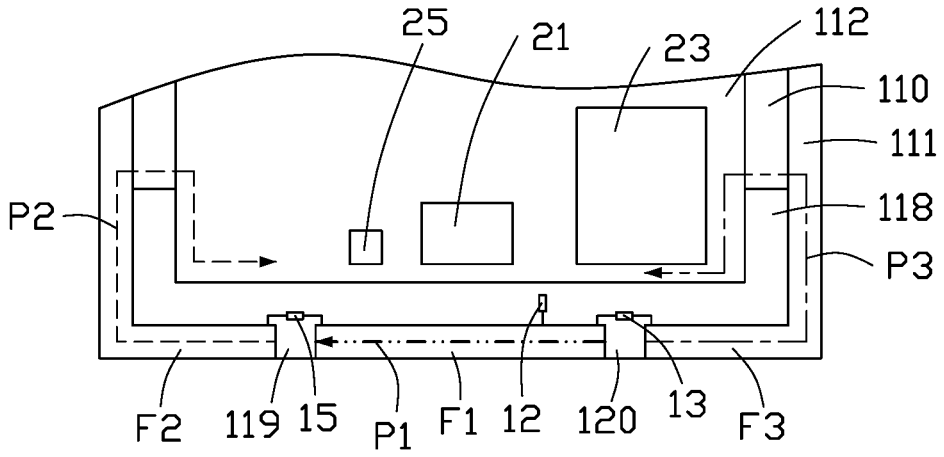
FIGS. 6A-6C are electric current diagrams of the antenna structure in FIG. 5.

In one embodiment, as shown in FIG. 6A, the switching circuits 13, 15 are both in the open circuit state, and a circuit between the first radiating portion F1 and the second radiating portion F2 and a circuit between the first radiating portion F1 and the third radiating portion F3 are open. When the first feed portion 12 feeds an electric current, the electric current passes through the first radiating portion F1 toward the first gap 119 along a current path P1 to excite a first resonance mode and generate a radiation signal in a first frequency band. Thus, the first radiating portion F1 forms a monopole antenna. The electric current is further coupled from the first radiating portion F1 to the second radiating portion F2 along a current path P2 to excite a second resonance mode and generate a radiation signal in a second frequency band. Thus, the second radiating portion F2 forms a loop antenna. The electric current is further coupled from the first radiating portion F1 to the third radiating portion F3 along a current path P3 to excite a third resonance mode and generate a radiation signal in a third frequency band. Thus, the third radiating portion F3 forms a loop antenna.

In one embodiment, the first resonance mode is a long term evolution advanced (LTE-A) low-frequency mode, the second resonance mode is an LTE-A high-frequency mode, and the third resonance mode is an LTE-A mid-frequency mode. The first frequency band is 700-960 MHz. The second frequency band is 2300-2690 MHz. The third frequency band is 1710-2170 MHz.

Figure 6B:
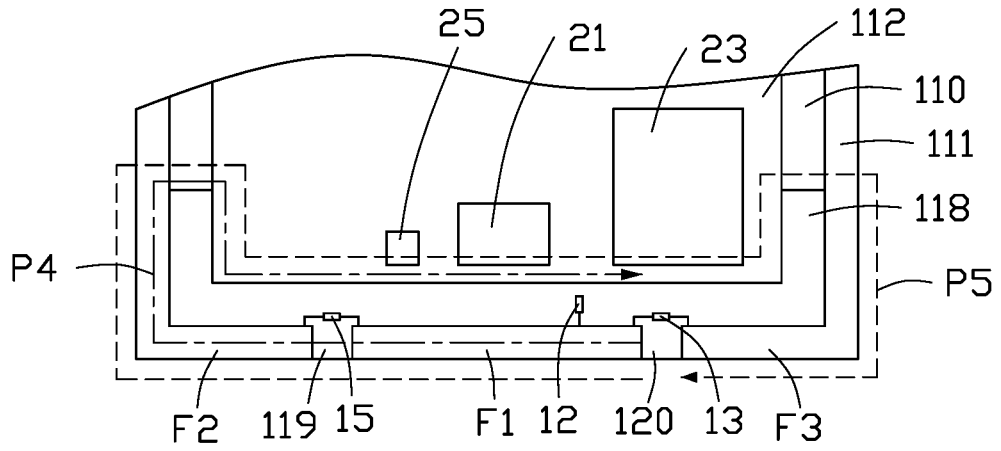

As shown in FIG. 6B, the switching circuit 13 is in the open circuit state while the switching circuit 15 is in the closed circuit state. Thus, the first radiating portion F1 is electrically coupled to the second radiating portion F2, and a circuit between the first radiating portion F1 and the third radiating portion F3 is open. When the first feed portion 12 feeds an electric current, the electric current passes through the first radiating portion F1 and the second radiating portion F2 along a current path P4 to excite a fourth resonance mode and generate a radiation signal in a fourth frequency band. The electric current further passes through the first radiating portion F1, the second radiating portion F2, the system ground surface 110 and the middle frame 112, and the third radiating portion F3 along a current path P5 to excite a fifth resonance mode and generate a radiation signal in a fifth frequency band.

In one embodiment, the fourth resonance mode is an ultra-mid-frequency mode, and the fifth resonance mode is an ultra-high-frequency mode. The fourth frequency band is 1447.9-1510.9 MHz, and the fifth frequency band is 3400-3800 MHz.

Figure 6C:
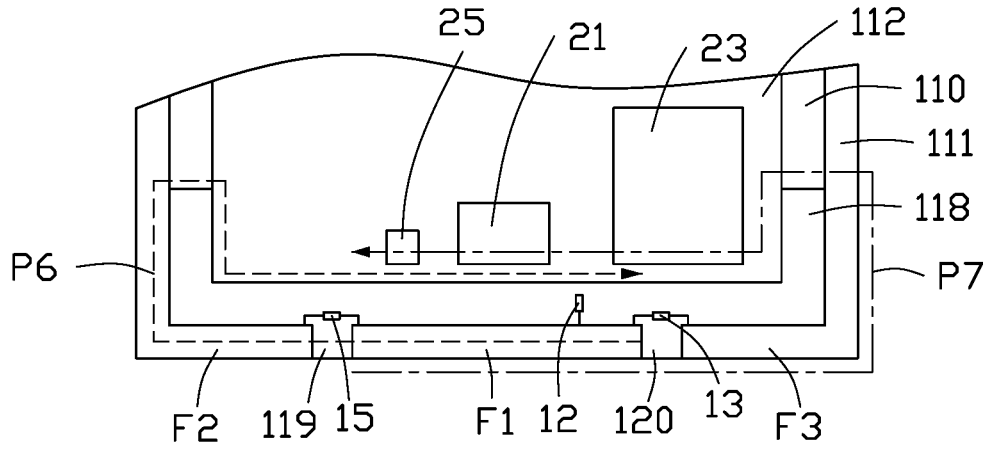

As shown in FIG. 6C, the switching circuit 13 is in the closed circuit state while the switching circuit 15 is in the open circuit state. Thus, a circuit between the first radiating portion F1 and the second radiating portion F2 is open, and the first radiating portion F1 is electrically coupled to the second radiating portion F3. When the first feed portion 12 feeds an electric current, the electric current is coupled from the first radiating portion F1 to the second radiating portion F2 and then pass through the system ground surface 110 and the middle frame 112 along a current path P6 to excite the second resonance mode and generate the radiation signal in the second frequency band. The electric current further passes through the first radiating portion F1, the third radiating portion F3, and the system ground surface 110 and the middle frame 112 along a current path P7 to excite the first resonance mode and generate the radiation signal in the first frequency band.

The switching circuits 13, 15 may be one-way switches, two-way switches, two-way switches with a matching component, multi-way switches with a matching component, or the like.

Figure 7A:
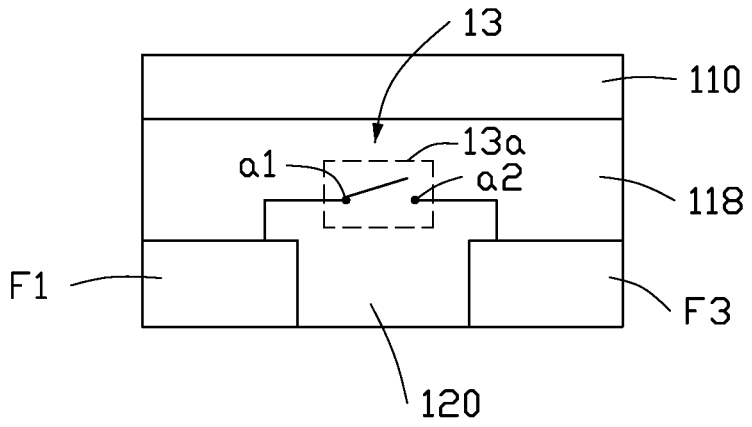
FIGS. 7A-7D are diagrams of a switching circuit of the antenna structure in FIG. 5.

As shown in FIG. 7*a*, in one embodiment, the switching circuit 13 includes a one-way switch 13*a*. The one-way switch 13*a* includes a movable contact a1 and a fixed contact a2. The movable contact a1 is electrically coupled to the first radiating portion F1. The fixed contact a2 is electrically coupled to the third radiating portion F3. Thus, by controlling the one-way switch 13*a* to open or close, the switching circuit 13 is controlled to switch between the open state and the closed state to open or close a circuit between the first radiating portion F1 and the third radiating portion F3 to adjust a radiation frequency.

Figure 7B:
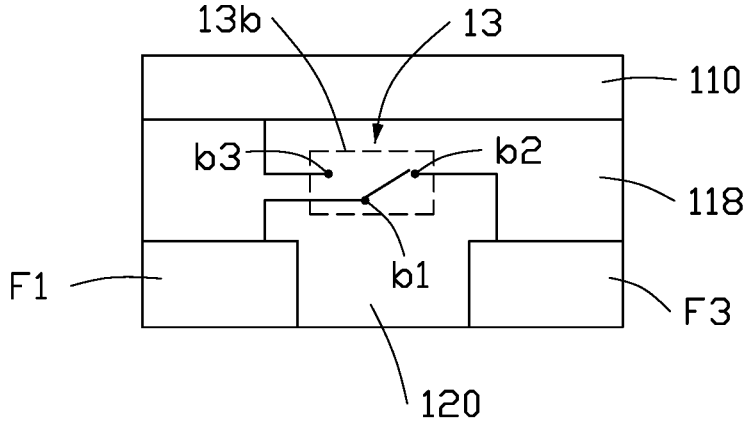

As shown in FIG. 7B, in one embodiment, the switching circuit 13 includes a two-way switch 13*b*. The two-way switch 13*b* includes a movable contact b1, a first fixed contact b2, and a second fixed contact b3. The movable contact b1 is electrically coupled to the first radiating portion F1. The first fixed contact b2 is electrically coupled to the third radiating portion F3. The second fixed contact b3 is electrically coupled to the system ground surface 110.

The movable contact b1 is controlled to switch between the first fixed contact b2 and the second fixed contact b3. Thus, the first radiating portion F1 is switched to electrically couple to the third radiating portion F3 or the system ground surface 110. When the first radiating portion F1 is electrically coupled to the third radiating portion F3, the switching circuit 13 is in the closed state. When the first radiating portion F1 is electrically coupled to the system ground surface 110, the switching circuit 13 is in the open state. In other words, by controlling the movable contact b1 to switch between the first fixed contact b2 and the second fixed contact b3, the switching circuit 13 is controlled to switch between the open state and the closed state to open or close a circuit between the first radiating portion F1 and the third radiating portion F3 to adjust a radiation frequency.

Figure 7C:
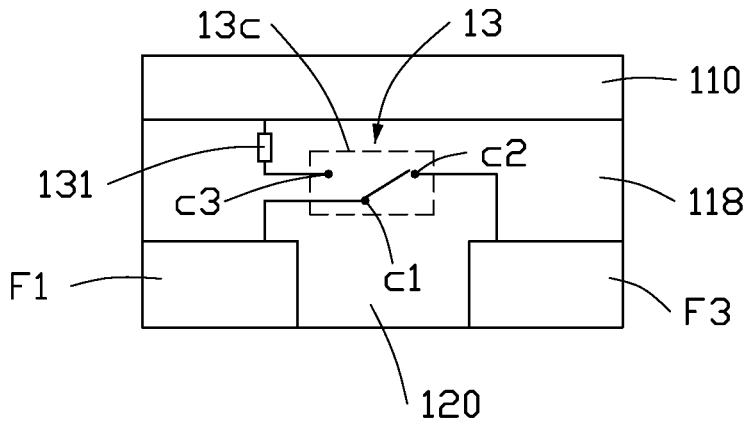

As shown in FIG. 7C, in one embodiment, the switching circuit 13 includes a two-way switch 13*c* and a matching component 131. The two way switch 13*c* includes a movable contact c1, a first fixed contact c2, and a second fixed contact c3. The movable contact c1 is electrically coupled to the first radiating portion F1. The first fixed contact c2 is electrically coupled to the third radiating portion F3. The second fixed contact c3 is electrically coupled through the matching component 131 to the system ground surface 110. The matching component 131 includes a predetermined impedance. The matching component 131 may include an inductor, a capacitor, or a combination of the two.

The movable contact c1 is controlled to switch between the first fixed contact c2 and the second fixed contact c3 to control the first radiating portion F1 to electrically couple to the third radiating portion F3 or the system ground surface 110. When the first radiating portion F1 is electrically coupled to the third radiating portion F3, the switching circuit 13 is in the closed state. When the first radiating portion F1 is electrically coupled through the matching component 131 to the system ground surface 110, the switching circuit 13 is in the open state. In other words, by controlling the movable contact c1 to switch between the first fixed contact c2 and the second fixed contact c3, the switching circuit 13 is controlled to switch between the open state and the closed state to open or close a circuit between the first radiating portion F1 and the third radiating portion F3 to adjust a radiation frequency.

Figure 7D:
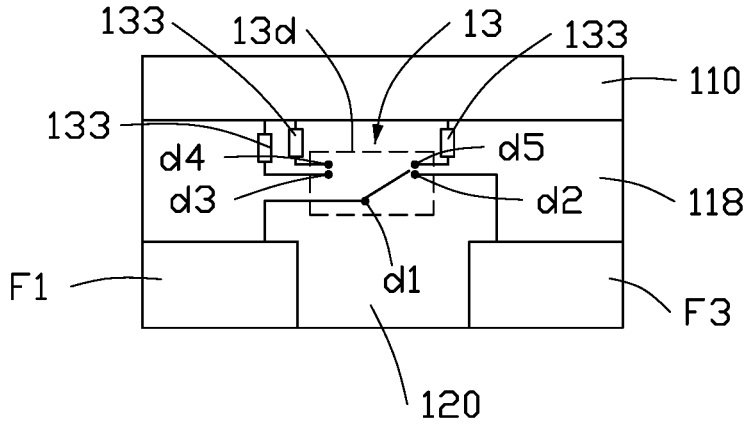

As shown in FIG. 7D, in one embodiment, the switching circuit 13 includes a multiway switch 13*d* and at least one matching component 133. In one embodiment, the multiway switch 13*d* is a four-way switch, and the switching circuit 13 includes three matching components 133. The multiway switch 13*d* includes a movable contact d1, a first fixed contact d2, a second fixed contact d3, a third fixed contact d4, and a fourth fixed contact d5. The movable contact d1 is electrically coupled to the first radiating portion F1. The first fixed contact d2 is electrically coupled to the third radiating portion F3. Each of the second fixed contact d3, the third fixed contact d4, and the fourth fixed contact d5 is electrically coupled through a corresponding one of the matching components 133 to the system ground surface 110. Each of the matching components 133 includes a predetermined impedance. The predetermined impedances of the matching components 133 may be the same or may be different. Each of the matching components 133 may include an inductor, a capacitor, or a combination of the two. Each of the matching components 133 may be electrically coupled to a same position or a different position of the system ground surface 110.

The movable contact d1 is controlled to switch between the first fixed contact d2, the second fixed contact d3, the third fixed contact d4, and the fourth fixed contact d5 to control the first radiating portion F1 to electrically couple to the third radiating portion F3 or the system ground surface 110 through different one of the matching components 133. When the first radiating portion F1 is electrically coupled to the third radiating portion F3, the switching circuit 13 is in the closed state. When the first radiating portion F1 is electrically coupled through one of the matching components 131 to the system ground surface 110, the switching circuit 13 is in the open state. In other words, by controlling the movable contact d1 to switch between the first fixed contact d2, the second fixed contact d3, the third fixed contact d4, and the fourth fixed contact d5, the switching circuit 13 is controlled to switch between the open state and the closed state to open or close a circuit between the first radiating portion F1 and the third radiating portion F3 to adjust a radiation frequency.

In one embodiment, the border frame 111 is electrically coupled to the system ground surface 110 by clipping, welding, pinning, or other means. An electrical contact point between the border frame 111 and the system ground surface 110 may be adjusted according to requirements for adjusting a low-frequency band. For example, an electrical contact point adjacent to the first feed portion 12 raises the frequency of the low-frequency band, and an electrical contact point further away from the first feed portion 12 lowers the frequency of the low-frequency band.

Figure 8:
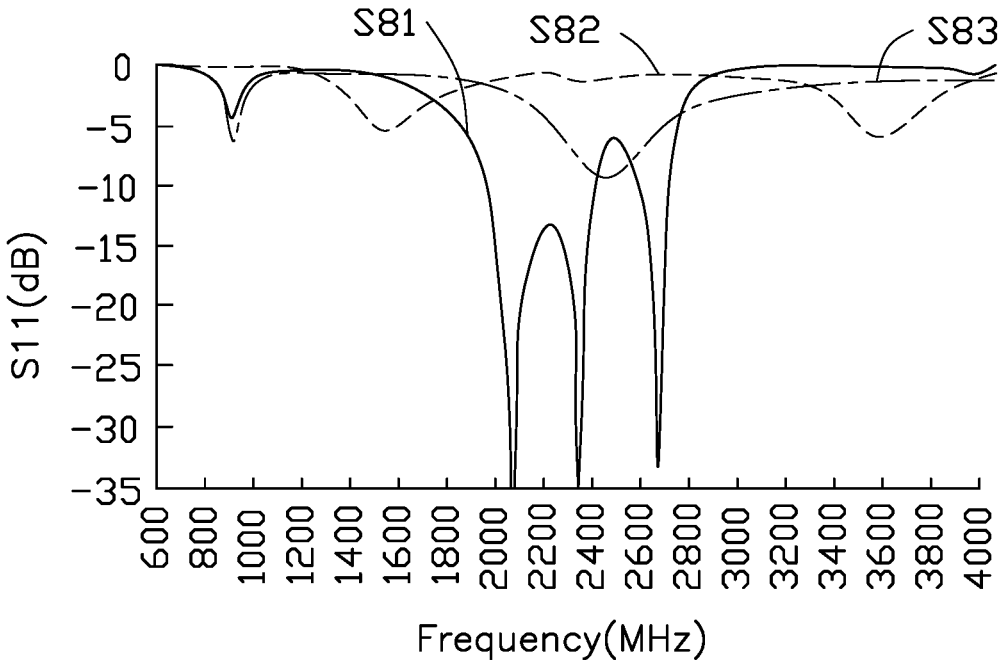
FIG. 8 is a graph of S11 parameters of the antenna structure in FIG. 1.

FIG. 8 shows a graph of scattering parameters (S11 parameters) of the antenna structure 100. A plotline S81 represents S11 parameters of the antenna structure 100 when the switching circuits 13, 15 are both in the open state. A plotline S82 represents S11 parameters of the antenna structure 100 when the switching circuit 13 is in the open state while the switching circuit 15 is in the closed state. A plotline S83 represents S11 parameters of the antenna structure 100 when the switching circuit 13 is in the closed state while the switching circuit 15 is in the open state.

Figure 9:
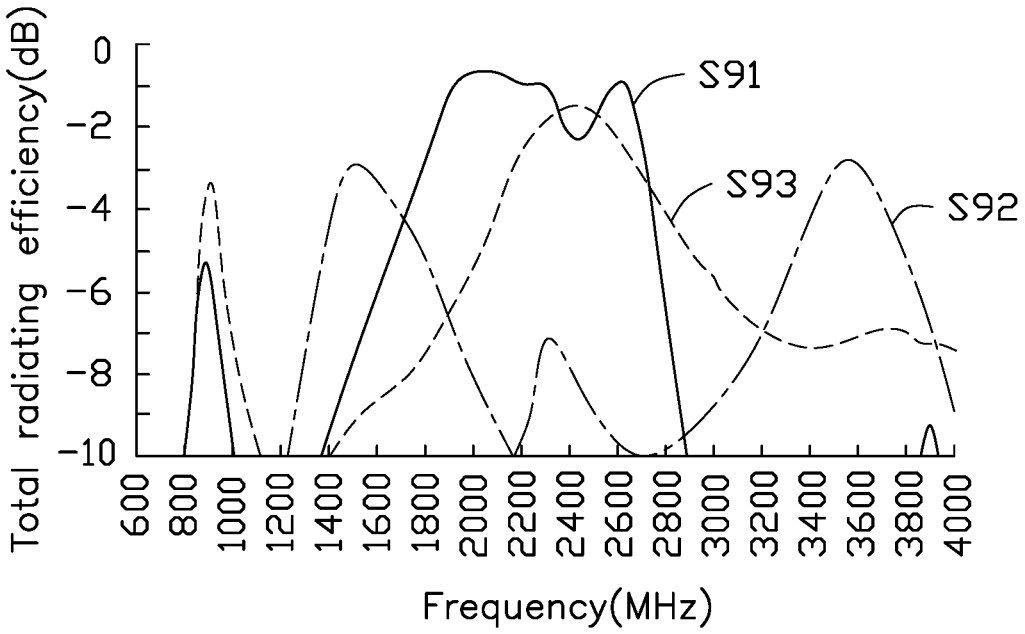
FIG. 9 is a graph of total radiation efficiency of the antenna structure in FIG. 1.

FIG. 9 shows a graph of total radiation efficiency of the antenna structure 100. A plotline S91 represents a total radiation efficiency of the antenna structure 100 when the switching circuits 13, 15 are both in the open state. A plotline S92 represents a total radiation efficiency of the antenna structure 100 when the switching circuit 13 is in the open state while the switching circuit 15 is in the closed state. A plotline S93 represents a total radiation efficiency of the antenna structure 100 when the switching circuit 13 is in the closed state while the switching circuit 15 is in the open state.

As shown in FIGS. 8 and 9, when the switching circuits 13, 15 are both in the open state, the antenna structure 100 operates in the LTE-A low, mid, and high-frequency bands. When the switching circuit 13 is in the closed state while the switching circuit 15 is in the open state, the first radiating portion F1 is electrically coupled to the third radiating portion F3 to excite corresponding low and high-frequency bands. When the switching circuit 13 is in the open state while the switching circuit 15 is in the closed state, the first radiating portion F1 is electrically coupled to the second radiating portion F2 to excite the ultra-mid and ultra-high-frequency bands.

In other words, the antenna structure 100 uses the switching circuits 13, 15 to excite different resonance modes, such as the low, mid, and high-frequency modes and the ultra-mid and ultra-high frequency modes to cover all frequency bands in common use. Specifically, the antenna structure 100 operating in the low-frequency mode covers GSM850/900/WCDMA Band5/Band8. The mid-frequency mode covers GSM 1800/1900/WCDMA 2100(1710-2170 MHz). The high-frequency band covers LTE-A Band1, Band40, Band41 (2300-2690 MHz). The ultra-mid-frequency band covers 1447.9-1510.9 MHz. The ultra-high-frequency band covers 3400-3800 MHz. The antenna structure 100 can be applied in GSM Qual-band, UMTS Band I/II/V/VIII frequencies and global LTE 850/900/1800/1900/2100/2300/2500 frequencies.

As described above, the border frame 111 of the antenna structure 100 uses at least one gap (the first gap 119 and the second gap 120) and corresponding switching circuits 13, 15. Thus, the low, mid, high, ultra-mid, and ultra-high frequencies are covered by the antenna structure 100 to satisfy carrier aggregation (CA) requirements.

Figure 10:
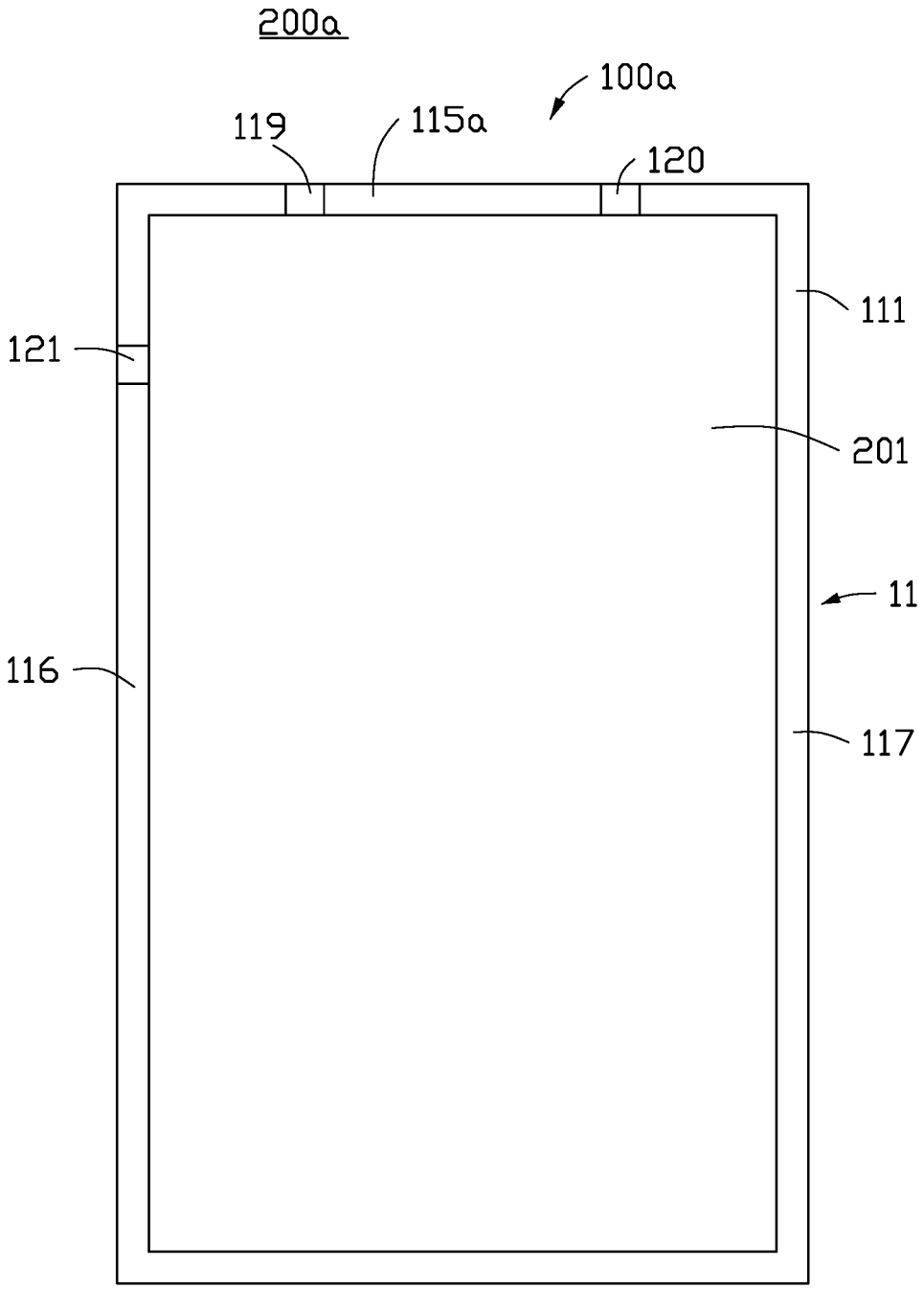
FIG. 10 is a diagram of a second embodiment of a wireless communication device including an antenna structure.
Figure 11:
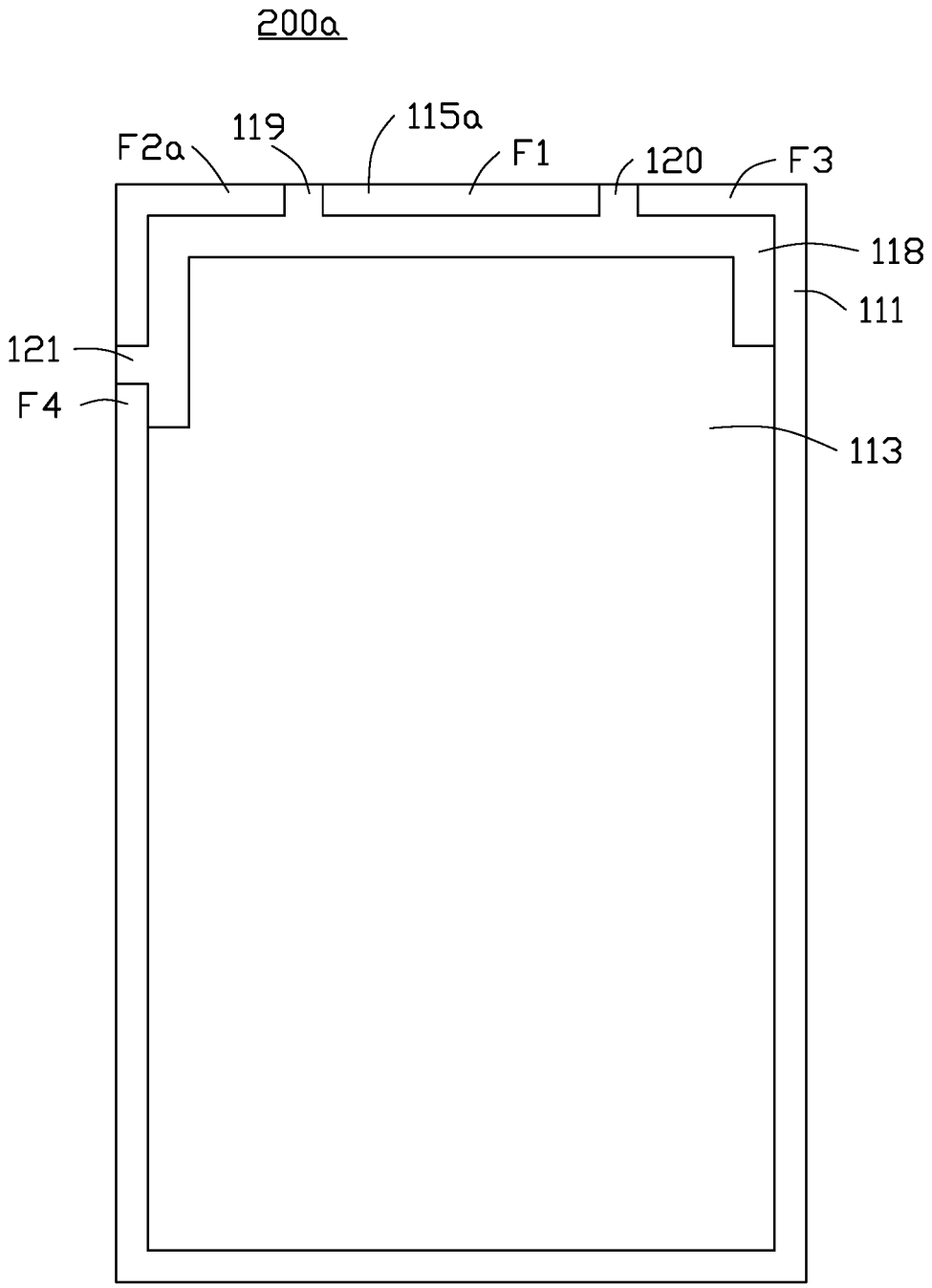
FIG. 11 is a diagram of internal components of the antenna structure in FIG. 10.
Figure 12:
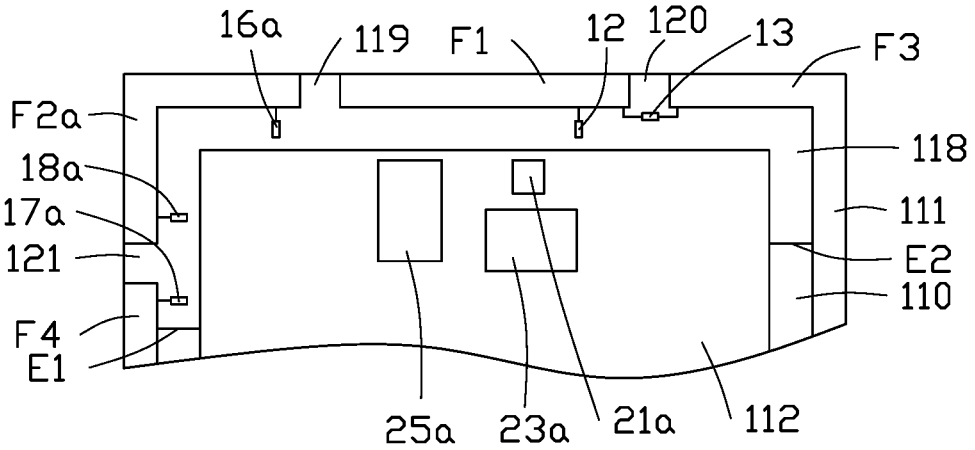
FIG. 12 is a partial view of the antenna structure in FIG. 10.

FIGS. 10-12 show a second embodiment of an antenna structure 100*a* applicable in a mobile phone, a personal digital assistant, or other wireless communication device 200*a* for transmitting and receiving wireless signals.

The antenna structure 100*a* includes a housing 11, a first feed portion 12, and at least one switching circuit. The housing 11 includes at least a system ground surface 110, a border frame 111, a middle frame 112, and a back cover 113. The border frame 111 includes an end portion 115*a*, a first side portion 116, and a second side portion 117. The housing 11 includes a slot 118 and at least one gap. The wireless communication device 200*a* includes a first electronic component 21*a*, a second electronic component 23*a*, and a third electronic component 25*a*.

A difference between the antenna structure 100*a* and the antenna structure 100 is that the end portion 115*a* is a top end of the wireless communication device 200*a*.

Another difference between the antenna structure 100*a* and the antenna structure 100 is that the housing 11 of the antenna structure 100*a* includes three gaps, a first gap 119, a second gap 120, and a third gap 121. The three gaps are defined in the border frame 111. Specifically, the third gap 121 is defined in the first side portion 116 adjacent to the first gap 119. The third gap 121 is defined in the border frame 111 and is coupled to the slot 118.

The first gap 119, the second gap 120, and the third gap 121 cut across and cut through the border frame 112. The slot 118, the first gap 119, the second gap 120, and the third gap 121 cooperatively divide the housing 11 into a first radiating portion F1, a second radiating portion F2*a*, a third radiating portion F3, and a fourth radiating portion F4. In one embodiment, a portion of the border frame 111 between the first gap 119 and the second gap 120 is the first radiating portion F1. A portion of the border frame 111 between the first gap 119 and the third gap 121 is the second radiating portion F2*a*. A portion of the border frame 111 between the second gap 120 and an endpoint E2 of the second side portion 117 is the third radiating portion F3. A portion of the border frame 111 between the third gap 121 and an endpoint E1 of the first side portion 116 is the fourth radiating portion F4.

Another difference between the antenna structure 100*a* and the antenna structure 100 is that the antenna structure 100*a* includes a first electronic component 21*a*, a second electronic component 23*a*, and a third electronic component 25*a*. The first electronic component 21*a* may be a proximity sensor. The first electronic component 21*a* is mounted in the middle frame 112 adjacent to a center edge of the first radiating portion F1. The second electronic component 23*a* may be a front camera mounted in the middle frame 112 on a side of the first electronic component 21*a* away from the first radiating portion F1. The third electronic component 25*a* may be a microphone mounted in the middle frame 112 adjacent to an edge of the first radiating portion F1. The third electronic component 25*a* is mounted between the first electronic component 21*a* and the first gap 119.

In other embodiment, the second electronic component 23 and the third electronic component 25 may be mounted in different locations according to requirements.

In one embodiment, each of the first electronic component 21*a*, the second electronic component 23*a*, and the third electronic component 25*a* is insulated from the first radiating portion F1 by the slot 118. The first electronic component 21*a* is spaced 2-10 mm from the slot 118, and the third electronic component 25*a* is spaced 2-10 mm from the slot 118.

One end of the first feed portion 12 is electrically coupled to a signal feed point (not shown) of the system ground surface 110 by a clip, a microgap, a gap, a coaxial cable, or other connection means. A second end of the first feed portion 12 is electrically coupled through a matching circuit (not shown) to a side of the first radiating portion F1 adjacent to the second gap 120 for feeding an electric current to the first radiating portion F1.

Another difference between the antenna structure 100 and the antenna structure 100*a* is that the antenna structure 100*a* further includes a second feed portion 16*a*, a third feed portion 17*a*, and a ground portion 18*a*. One end of the second feed portion 16*a* is electrically coupled to a signal feed point of the system ground surface 110 by a clip, a microgap, a gap, a coaxial cable, or other connection means. A second end of the second feed portion 16*a* is electrically coupled through a matching circuit (not shown) to a side of the second radiating portion F2*a* adjacent to the first gap 119 for feeding an electric current to the second radiating portion F2*a*. One end of the third feed portion 17*a* is electrically coupled to a signal feed point of the system ground surface 110 by a clip, a microgap, a gap, a coaxial cable, or other connection means. A second end of the third feed portion 17*a* is electrically coupled through a matching circuit (not shown) to a side of the fourth radiating portion F4 adjacent to the third gap 121 for feeding an electric current to the fourth radiating portion F4. One end of the ground portion 18*a* is electrically coupled to a side of the second radiating portion F2*a* adjacent to the third gap 121. A second end of the ground portion 18*a* is electrically coupled to the system ground surface 110 for grounding the second radiation portion F2*a*.

Another difference between the antenna structure 100*a* and the antenna structure 100 is that the antenna structure 100*a* only includes one switching circuit 13. The switching circuit 13 is mounted to the second gap 120. One end of the switching circuit 13 is electrically coupled to the first radiating portion F1, and a second end of the switching circuit 13 is electrically coupled to the third radiating portion F3. In other embodiments, the switching circuit 13 may be mounted to a different gap, such as the first gap 119 or the third gap 121 according to frequency band requirements. A structure of the switching circuit 13 may be one of the structures illustrated in FIGS. 7A-7D.

Figure 13A:
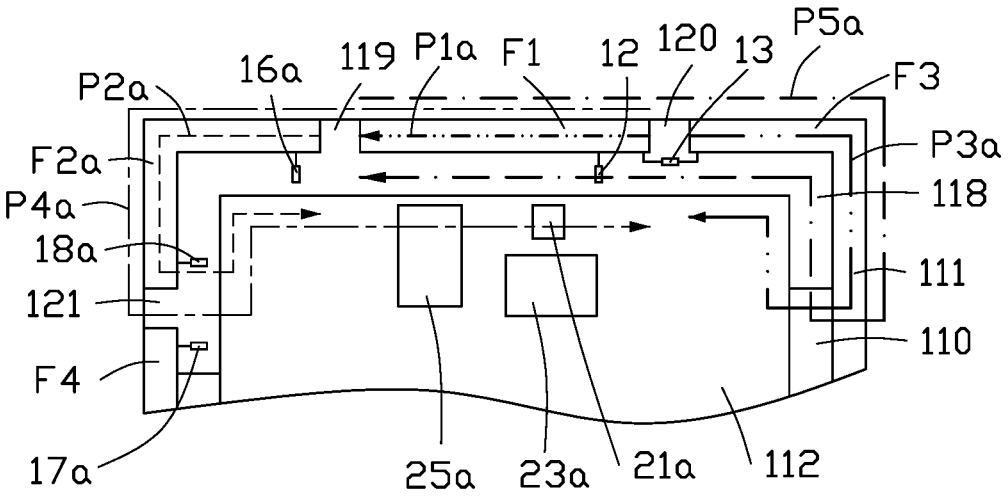
FIGS. 13A-13C are electric current diagrams of the antenna structure in FIG. 12.
Figure 13B:
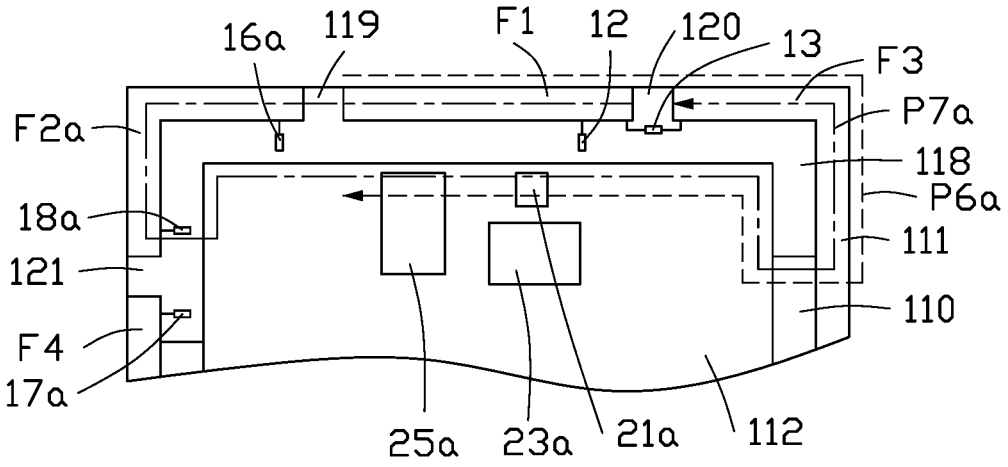

As shown in FIG. 13A, the switching circuit 13 is in the open circuit state. Thus, a circuit between the first radiating portion F1 and the third radiating portion F3 is open. When the first feed portion 12 feeds an electric current, the electric current passes through the first radiating portion F1 toward the first gap 119 along a current path P1*a*. Thus, the first radiating portion F1 forms a monopole antenna to excite a first resonance mode and generate a radiation signal in a first frequency band. The electric current is further coupled from the first radiating portion F1 to the second radiating portion F2*a* and pass through the ground portion to ground along a current path P2*a*. Thus, the second radiating portion F2*a* forms a loop antenna to excite a second resonance mode and generate a radiation signal in a second frequency band. The electric current is further coupled from the first radiating portion F1 to the third radiating portion F3 along a current path P3*a*. Thus, the third radiating portion F3 forms a loop antenna to excite a third resonance mode and generate a radiation signal in a third frequency band.

The electric current from the first feed portion 12 are further coupled from the first radiating portion F1 to the second radiating portion F2*a* toward the third gap 121 along a current path P4*a* to excite a fourth resonance mode and generate a radiation signal in a fourth frequency band. The electric current from the first feed portion 12 are further coupled from the first radiating portion F1 to the third radiating portion F3, and then passed through the system ground surface 110 and the middle frame 112 along a current path P5*a* to excite a fifth resonance mode and generate a radiation signal in a fifth frequency band.

Figure 13C:
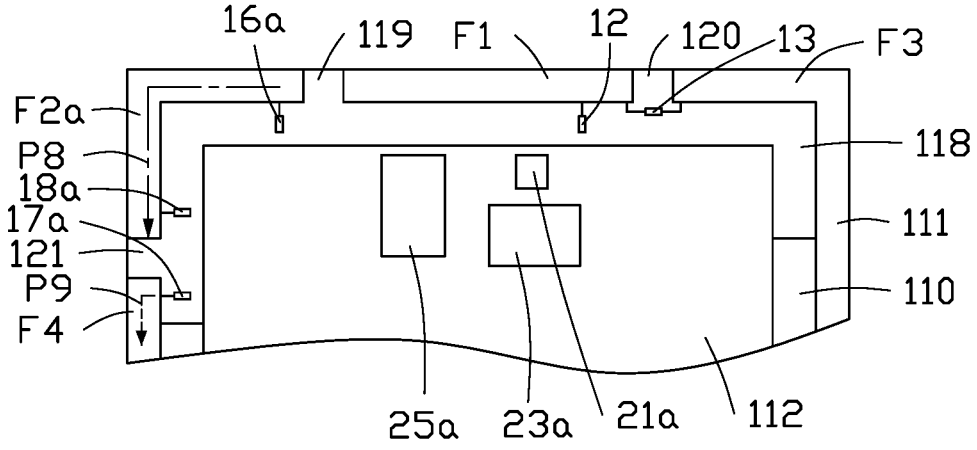

As shown in FIG. 13C, the switching circuit 13 is in the open circuit state. When the second feed portion 16*a* feeds electric current, the electric current passes through the second radiating portion F2*a* along a current path P8 to excite a sixth resonance mode and generate a radiation signal in a sixth frequency band. When the third feed portion 17*a* feeds electric current, the electric current passes through the fourth radiating portion F4 and the system ground surface 110 and the middle frame 112 along a current path P9 to excite a seventh resonance mode and generate a radiation signal in a seventh frequency band.

In one embodiment, the sixth resonance mode is a global positioning system (GPS) mode and a WIFI 2.4 GHz mode. The seventh resonance mode is a WIFI 5 GHz mode and an ultra-high-frequency mode. The sixth resonance mode has a has a frequency band frequency of 1575 MHz and 2400-2480 MHz. The seventh resonance mode has a frequency band frequency of 5150-5850 MHz and 3400-3800 MHz.

Figure 14:
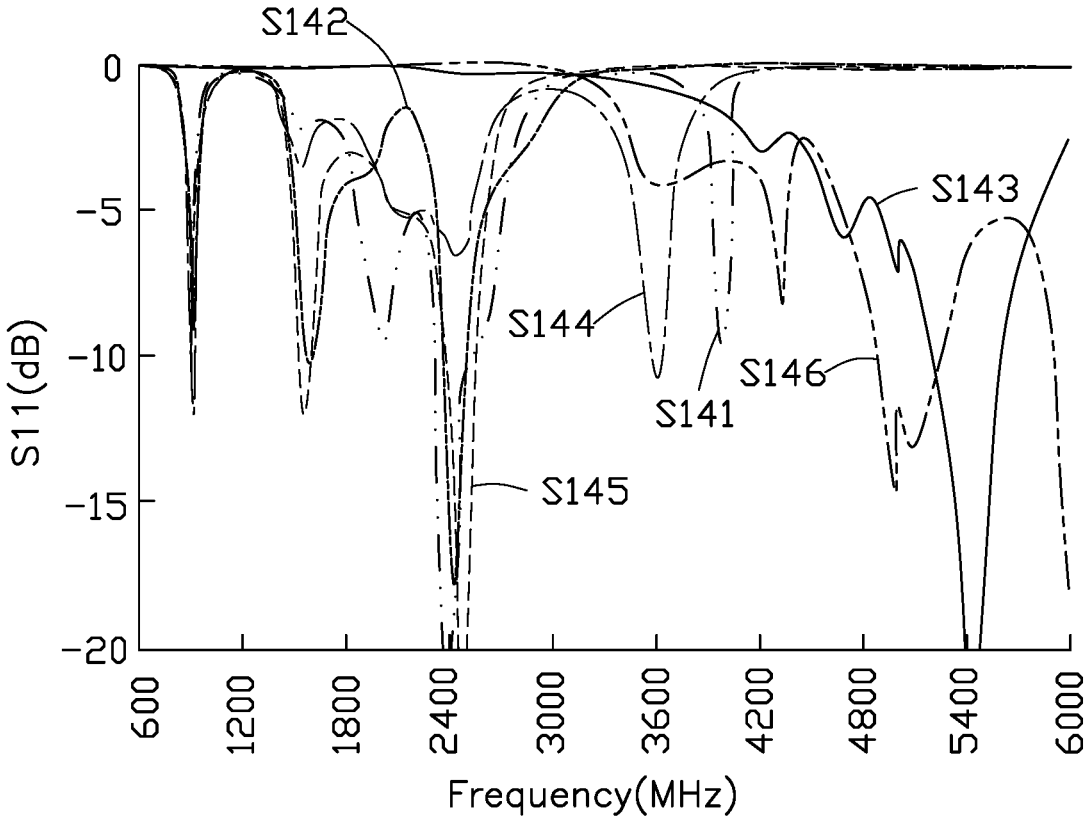
FIG. 14 is a graph of S11 parameters of the antenna structure in FIG. 10.

FIG. 14 shows a graph of scattering parameters (S11 parameters) of the antenna structure 100*a*. A plotline S141 represents S11 parameters of the LTE-A low, mid, high, ultra-mid, and ultra-high-frequency bands when the first feed portion 12 feeds electric current when the switching circuit 13 is in the open state. A plotline S142 represents S11 parameters of the GPS and WIFI 2.4 GHz bands when the second feed portion 16*a* feeds electric current when the switching circuit 13 is in the open state. A plotline S143 represents S11 parameters of the WIFI 5 GHz and ultra-high-frequency bands when the third feed portion 17*a* feeds electric current when the switching circuit 13 is in the open state. A plotline S144 represents S11 parameters of the LTE-A low, mid, high, ultra-mid, and ultra-high-frequency bands when the first feed portion 12 feeds electric current when the switching circuit 13 is in the closed state. A plotline S145 represents S11 parameters of the GPS and WIFI 2.4 GHz bands when the second feed portion 16*a* feeds electric current when the switching circuit 13 is in the closed state. A plotline S146 represents S11 parameters of the WIFI 5 GHz and ultra-high-frequency bands when the third feed portion 17*a* feeds electric current when the switching circuit 13 is in the closed state.

Figure 15:
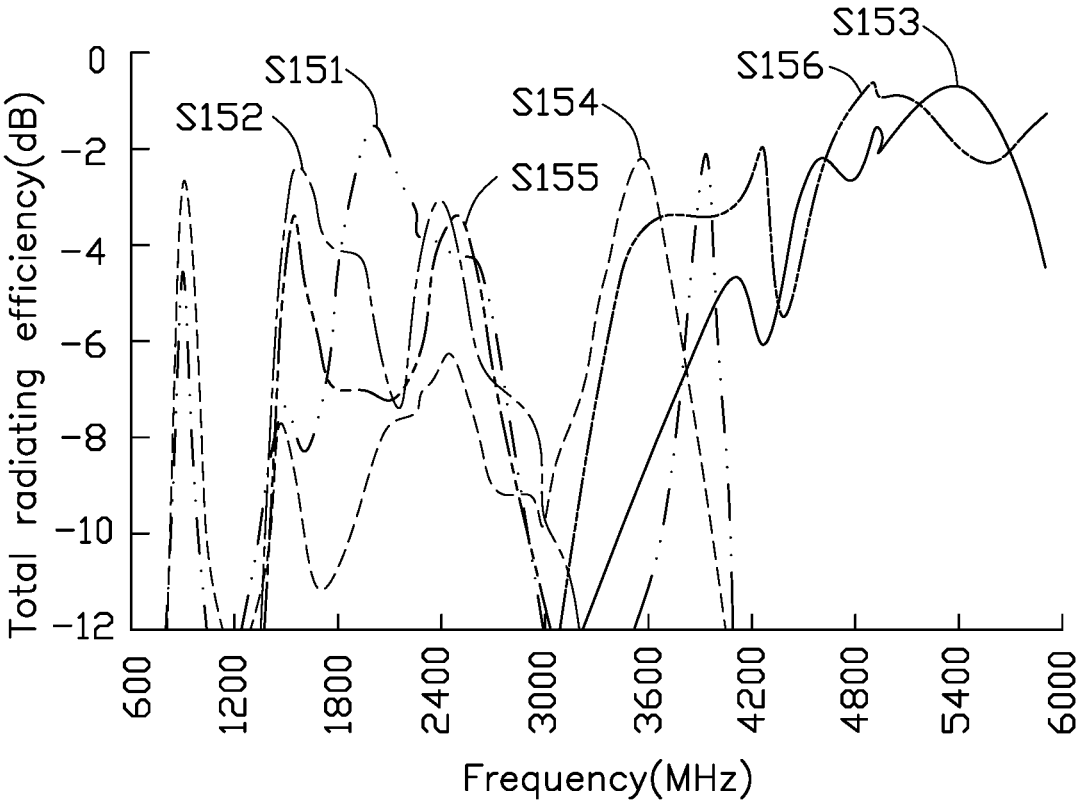
FIG. 15 is a graph of total radiation efficiency of the antenna structure in FIG. 10.

FIG. 15 shows a graph of total radiation efficiency of the antenna structure 100*a*. A plotline S151 represents a total radiation efficiency of the LTE-A low, mid, high, ultra-mid, and ultra-high-frequency bands when the first feed portion 12 feeds electric current when the switching circuit 13 is in the open state. A plotline S152 represents a total radiation efficiency of the GPS and WIFI 2.4 GHz bands when the second feed portion 16*a* feeds electric current when the switching circuit 13 is in the open state. A plotline S153 represents a total radiation efficiency of the WIFI 5 GHz and ultra-high-frequency bands when the third feed portion 17*a* feeds electric current when the switching circuit 13 is in the open state. A plotline S154 represents a total radiation efficiency of the LTE-A low, mid, high, ultra-mid, and ultra-high-frequency bands when the first feed portion 12 feeds electric current when the switching circuit 13 is in the closed state. A plotline S155 represents a total radiation efficiency of the GPS and WIFI 2.4 GHz bands when the second feed portion 16*a* feeds electric current when the switching circuit 13 is in the closed state. A plotline S156 represents a total radiation efficiency of the WIFI 5 GHz and ultra-high-frequency bands when the third feed portion 17*a* feeds electric current when the switching circuit 13 is in the closed state.

As shown in FIGS. 14 and 15, when the switching circuit 13 is in the open state, the antenna structure 100*a* operates in the low, mid, high, ultra-mid, ultra-high, GPS, WIFI 2.4 GHz, and WIFI 5 GHz frequency bands. When the switching circuit 13 is in the closed state, the first radiating portion F1 is electrically coupled to the third radiating portion F3 to excite more enhanced low and ultra-high-frequency bands and simultaneously cover the mid, high, ultra-mid, GPS, WIFI 2.4 GHz, and WIFI 5 GHz frequency bands.

In other words, the antenna structure 100*a* uses the switching circuit 13 to excite different resonance modes, such as the low, mid, high, ultra-mid, ultra-high, GPS, WIFI 2.4 GHz, and WIFI 5 GHz frequency modes to cover all frequency bands in common use. Specifically, the antenna structure 100*a* operating in the low-frequency mode covers GSM850/900/WCDMA Band5/Band8. The mid-frequency mode covers GSM 1800/1900/WCDMA 2100(1710-2170 MHz). The high-frequency band covers LTE-A Band1, Band40, Band41(2300-2690 MHz). The ultra-mid-frequency band covers 1447.9-1510.9 MHz. The ultra-high-frequency band covers 3400-3800 MHz. The antenna structure 100*a* can be applied in GSM Qual-band, UMTS Band I/II/V/VIII frequencies and global LTE 850/900/1800/1900/2100/2300/2500 frequencies.

As described above, the border frame 111 of the antenna structure 100*a* uses at least one gap (the first gap 119, the second gap 120, and the third gap 121) and the switching circuit 13. Thus, the low, mid, high, ultra-mid, and ultra-high frequencies are covered by the antenna structure 100*a* to satisfy carrier aggregation (CA) requirements.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An antenna structure comprising:

a housing comprising a border frame and a back cover, the border frame and the back cover both made of metal, the border frame surrounding a periphery of the back cover, the back cover comprising a slot, the border frame comprising at least one gap, the slot and the at least one gap cooperatively dividing the border frame into at least two radiating portions;

at least one switching circuit mounted to the at least one gap and electrically connected to the at least two radiating portions on opposite sides of the at least one switching circuit; wherein:

the at least one switching circuit is controlled to switch between an open circuit state and a closed circuit state; and a length of the at least two radiating portions is changed by the at least one switching circuit being switched between the open circuit state and the closed circuit state to adjust a bandwidth of the antenna structure.

2. The antenna structure of claim 1 further comprising two switching circuits, wherein:

the border frame comprises two gaps;

the slot and the two gaps cooperatively divide the border frame into three radiating portions;

each of the two switching circuits is mounted to a corresponding one of the two gaps and electrically connects to the two radiating portions on opposite sides of the gap.

3. The antenna structure of claim 2, wherein:

the border frame comprises an end portion, a first side portion, and a second side portion;

the first side portion and the second side portion respectively connect to opposite ends of the end portion;

the slot is defined in the back cover adjacent to the end portion and extends toward the first side portion and the second side portion;

a first gap and a second gap are defined in the end portion;

the first gap and the second gap cut across and cut through the border frame;

a portion of the border frame between the first gap and the second gap is a first radiating portion;

a portion of the border frame between the first gap and an endpoint of the first side portion is a second radiating portion;

a portion of the border frame between the second gap and an endpoint of the second side portion is a third radiating portion;

a first one of the switching circuits is mounted to the first gap and is electrically connected to the first radiating portion and the second radiating portion;

a second one of the switching circuits is mounted to the second gap and is electrically connected to the first radiating portion and the third radiating portion.

4. The antenna structure of claim 3 further comprising a first feed portion and a system ground surface, wherein:

the first feed portion electrically connects to the first radiating portion to feed electric current to the first radiating portion, the second radiating portion, and the third radiating portion;

when both of the two switching circuits are in the open circuit state when the first feed portion feeds electric current, the electric current passes through the first radiating portion toward the first gap to excite a first resonance mode and generate a radiation signal in a first frequency band, the electric current is further coupled to the second radiating portion to excite a second resonance mode and generate a radiation signal in a second frequency band, and the electric current is further coupled to the third radiating portion to excite a third resonance mode and generate a radiation signal in a third frequency band;

when the second one of the switching circuits is in the open circuit state and the first one of the switching circuits is in the closed circuit state when the first feed portion feeds electric current, the electric current passes through the first radiating portion and the second radiating portion to excite a fourth resonance mode and generate a radiation signal in a fourth frequency band, and the electric current further passes through the first radiating portion, the second radiating portion, the system ground surface, and the third radiating portion to excite a fifth resonance mode and generate a radiation signal in a fifth frequency band;

when the second one of the switching circuits is in the closed circuit state and the first one of the switching circuits is in the open circuit state when the first feed portion feeds electric current, the electric current is coupled from the first radiating portion to the second radiating portion and then pass through the system ground surface to excite the second resonance mode and generate the radiation signal in the second frequency band, and the electric current further passes through the first radiating portion, the third radiating portion, and the system ground surface to excite the first resonance mode and generate the radiation signal in the first frequency band.

5. The antenna structure of claim 4, wherein:

a frequency of the first frequency band is less than a frequency of the fourth frequency band;

the frequency of the fourth frequency band is less than a frequency of the third frequency band;

the frequency of the third frequency band is less than a frequency of the second frequency band; and the frequency of the second frequency band is less than a frequency of the firth frequency band.

6. The antenna structure of claim 1 further comprising a switching circuit, wherein:

the border frame comprises three gaps to divide the border frame into four radiating portions;

the at least one switching circuit is mounted to one of the three gaps and is electrically coupled to the two radiating portion on opposite sides of the gap.

7. The antenna structure of claim 6, wherein:

the border frame comprises an end portion, a first side portion, and a second side portion;

the first side portion and the second side portion are respectively coupled to opposite ends of the end portion;

the slot is defined in the back cover adjacent to the end portion and extends toward the first side portion and the second side portion;

a first gap and a second gap are defined in the end portion;

a third gap is defined in the first side portion;

the first gap, the second gap, and the third gap cut across and cut through the border frame;

a portion of the border frame between the first gap and the second gap is a first radiating portion;

a portion of the border frame between the first gap and the third gap is a second radiating portion;

a portion of the border frame between the second gap and an endpoint of the second side portion is a third radiating portion;

a portion of the border frame between the third gap and an endpoint of the first side portion is a fourth radiating portion;

the switching circuit is mounted to the second gap and is electrically connected to the first radiating portion and the third radiating portion.

8. The antenna structure of claim 7 further comprising a first feed portion, a second feed portion, a third feed portion, a ground portion, and a system ground surface, wherein:

the first feed portion electrically connects the first radiating portion to feed electric current to the first radiating portion, the second radiating portion, and the third radiating portion;

the second feed portion electrically connects the second radiating portion to feed electric current to the second radiating portion;

the third feed portion electrically connects the fourth radiating portion to feed electric current to the fourth radiating portion;

the ground portion electrically connects the second radiating portion;

when the switching circuit is in the open circuit state and the first feed portion feeds the electric current, the electric current passes through the first radiating portion toward the first gap to excite a first resonance mode and generate a radiation signal in a first frequency band, the electric current is further coupled from the first radiating portion to the second radiating portion and pass through the ground portion to ground to excite a second resonance mode and generate a radiation signal in a second frequency band, the electric current is further coupled from the first radiating portion to the third radiating portion to excite a third resonance mode and generate a radiation signal in a third frequency band, the electric current further passes through the first radiating portion and the second radiating portion toward the third gap to excite a fourth resonance mode and generate a radiation signal in a fourth frequency band, and the electric current further passes through the first radiating portion, the third radiating portion, and the system ground surface to excite a fifth resonance mode and generate a radiation signal in a fifth frequency band;

when the switching circuit is in the closed circuit state when the first feed portion feeds electric current, the electric current passes through the first radiating portion, the third radiating portion, and the system ground surface to excite the first resonance mode and generate the radiation signal in the first frequency band, the electric current is further coupled from the first radiating portion to the second radiating portion and pass through the system ground surface and the third radiating portion to excite the fifth resonance mode and generate the radiation signal in the fifth frequency band;

when the second feed portion feeds electric current, the electric current passes through the second radiating portion to excite a sixth resonance mode and generate a radiation signal in a sixth frequency band;

when the third feed portion feeds electric current, the electric current passes through the fourth radiating portion and the system ground surface to excite a seventh resonance mode and generate a radiation signal in a seventh frequency band.

9. The antenna structure of claim 8, wherein:

a frequency of the first frequency band is less than a frequency of the fourth frequency band;

the frequency of the fourth frequency band is less than a frequency of the third frequency band;

the frequency of the third frequency band is less than a frequency of the second frequency band;

the frequency of the second frequency band is less than a frequency of the fifth frequency band;

a portion of a frequency of the sixth frequency band is between the frequency of the fourth frequency band and the frequency of the third frequency band, and a remaining portion of the frequency of the sixth frequency band overlaps with the frequency of the second frequency band;

a frequency of the seventh frequency band is greater than or equal to the frequency of the fifth frequency band.

10. The antenna structure of claim 7 further comprising a system ground surface comprising a switch comprising a movable contact, a first fixed contact, and a second fixed contact, wherein:

the movable contact is electrically connected to the first radiating portion;

the first fixed contact is electrically connected to the third radiating portion; and the second fixed contact is electrically connected to the system ground surface.

11. The antenna structure of claim 10, wherein:

the second fixed contact is electrically connected to the system ground surface through a first matching component comprising a predetermined impedance.

12. The antenna structure of claim 11, wherein:

the switch further comprises a third fixed contact;

the third fixed contact is electrically connected to the system ground surface through a second matching component comprising a predetermined impedance;

the first matching component and the second matching component are electrically connected to different points of the system ground surface.

13. The antenna structure of claim 1 further comprising a system ground surface and a middle frame, wherein:

the system ground surface is made of metal for coupling the antenna structure to ground;

the border frame is mounted around a periphery of the system ground surface;

the middle frame is made of metal and layered over the system ground surface;

the back cover is mounted on a surface of the system ground surface opposite from the middle frame; and the system ground surface, the middle frame, and the back cover are integrally formed.

14. The antenna structure of claim 1 further comprising a first feed portion and a system ground surface, wherein the first feed portion is mounted in a clearance area between the system ground surface and the border frame.

15. The antenna structure of claim 1 further comprising a system ground surface, wherein:

the border frame is mounted around a periphery of the system ground surface and is spaced a same distance from the system ground surface at different points of the border frame.

16. The antenna structure of claim 1 further comprising a system ground surface, wherein:

the border frame is mounted around a periphery of the system ground surface and is spaced a different distance from the system ground surface at different points of the border frame.

17. A wireless communication device comprising an antenna structure, the antenna structure comprising:

a housing comprising a border frame and a back cover, the border frame and the back cover both made of metal, the border frame surrounding a periphery of the back cover, the back cover comprising a slot and the border frame comprising at least one gap, the slot and the at least one gap cooperatively dividing the border frame into at least two radiating portions;

at least one switching circuit mounted to the at least one gap and electrically coupled to the at least two radiating portions on opposite sides of the at least one switching circuit; wherein:

the at least one switching circuit is controlled to switch between an open circuit state and a closed circuit state; and a length of the at least two radiating portions is changed by the at least one switching circuit switched between the open circuit state and the closed circuit state to adjust a bandwidth of the antenna structure.

18. The wireless communication device of claim 17, wherein:

the antenna structure further comprises two switching circuits, a first feed portion, and a system ground surface;

the border frame comprises two gaps;

the slot and the two gaps cooperatively divide the border frame into three radiating portions;

each switching circuit is mounted to a corresponding one of the two gaps and is electrically coupled to the two radiating portions on opposite sides of the gap;

the border frame comprises an end portion, a first side portion, and a second side portion;

the first side portion and the second side portion are respectively coupled to opposite ends of the end portion;

the slot is defined in the back cover adjacent to the end portion and extends toward the first side portion and the second side portion;

a first gap and a second gap are defined in the end portion;

the first gap and the second gap cut across and cut through the end portion;

a portion of the border frame between the first gap and the second gap is a first radiating portion;

a portion of the border frame between the first gap and an endpoint of the first side portion is a second radiating portion;

a portion of the border frame between the second gap and an endpoint of the second side portion is a third radiating portion;

a first one of the switching circuits is mounted to the first gap and is electrically coupled to the first radiating portion and the second radiating portion;

a second one of the switching circuits is mounted to the second gap and is electrically coupled to the first radiating portion and the third radiating portion;

the first feed portion is electrically coupled to the first radiating portion to feed electric current to the first radiating portion, the second radiating portion, and the third radiating portion;

when both of the two switching circuits are in the open circuit state when the first feed portion feeds electric current, the electric current passes through the first radiating portion toward the first gap to excite a first resonance mode and generate a radiation signal in a first frequency band, the electric current is further coupled to the second radiating portion to excite a second resonance mode and generate a radiation signal in a second frequency band, and the electric current is further coupled to the third radiating portion to excite a third resonance mode and generate a radiation signal in a third frequency band;

when the second one of the switching circuits is in the open circuit state and the first one of the switching circuits is in the closed circuit state when the first feed portion feeds electric current, the electric current passes through the first radiating portion and the second radiating portion to excite a fourth resonance mode and generate a radiation signal in a fourth frequency band, and the electric current further passes through the first radiating portion, the second radiating portion, the system ground surface, and the third radiating portion to excite a fifth resonance mode and generate a radiation signal in a fifth frequency band;

when the second one of the switching circuits is in the closed circuit state and the first one of the switching circuits is in the open circuit state when the first feed portion feeds electric current, the electric current is coupled from the first radiating portion to the second radiating portion and then pass through the system ground surface to excite the second resonance mode and generate the radiation signal in the second frequency band, and the electric current further passes through the first radiating portion, the third radiating portion, and the system ground surface to excite the first resonance mode and generate the radiation signal in the first frequency band;

a frequency of the first frequency band is less than a frequency of the fourth frequency band;

the frequency of the fourth frequency band is less than a frequency of the third frequency band;

the frequency of the third frequency band is less than a frequency of the second frequency band; and the frequency of the second frequency band is less than a frequency of the firth frequency band.

19. The wireless communication device of claim 17, wherein:

the antenna structure further comprises a switching circuit, a first feed portion, a second feed portion, a third feed portion, a ground portion, and a system ground surface;

the border frame comprises three gaps to divide the border frame into four radiating portions;

the at least one switching circuit is mounted to one of the three gaps and is electrically coupled to the two radiating portion on opposite sides of the gap;

the border frame comprises an end portion, a first side portion, and a second side portion;

the first side portion and the second side portion are respectively coupled to opposite ends of the end portion;

the slot is defined in the back cover adjacent to the end portion and extends toward the first side portion and the second side portion;

a first gap and a second gap are defined in the end portion;

a third gap is defined in the first side portion;

the first gap, the second gap, and the third gap cut across and cut through the border frame;

a portion of the border frame between the first gap and the second gap is a first radiating portion;

a portion of the border frame between the first gap and the third gap is a second radiating portion;

a portion of the border frame between the second gap and an endpoint of the second side portion is a third radiating portion;

a portion of the border frame between the third gap and an endpoint of the first side portion is a fourth radiating portion;

the switching circuit is mounted to the second gap and is electrically coupled to the first radiating portion and the third radiating portion;

the first feed portion is electrically coupled to the first radiating portion to feed electric current to the first radiating portion, the second radiating portion, and the third radiating portion;

the second feed portion is electrically coupled to the second radiating portion to feed electric current to the second radiating portion;

the third feed portion is electrically coupled to the fourth radiating portion to feed electric current to the fourth radiating portion;

the ground portion is electrically coupled to the second radiating portion to couple the second radiating portion to ground;

when the switching circuit is in the open circuit state when the first feed portion feeds electric current, the electric current passes through the first radiating portion toward the first gap to excite a first resonance mode and generate a radiation signal in a first frequency band, the electric current is further coupled from the first radiating portion to the second radiating portion and pass through the ground portion to ground to excite a second resonance mode and generate a radiation signal in a second frequency band, the electric current is further coupled from the first radiating portion to the third radiating portion to excite a third resonance mode and generate a radiation signal in a third frequency band, the electric current further passes through the first radiating portion and the second radiating portion toward the third gap to excite a fourth resonance mode and generate a radiation signal in a fourth frequency band, and the electric current further passes through the first radiating portion, the third radiating portion, and the system ground surface to excite a fifth resonance mode and generate a radiation signal in a fifth frequency band;

when the switching circuit is in the closed circuit state when the first feed portion feeds electric current, the electric current passes through the first radiating portion, the third radiating portion, and the system ground surface to excite the first resonance mode and generate the radiation signal in the first frequency band, the electric current is further coupled from the first radiating portion to the second radiating portion and pass through the system ground surface and the third radiating portion to excite the fifth resonance mode and generate the radiation signal in the fifth frequency band;

when the second feed portion feeds electric current, the electric current passes through the second radiating portion to excite a sixth resonance mode and generate a radiation signal in a sixth frequency band;

when the third feed portion feeds electric current, the electric current passes through the fourth radiating portion and the system ground surface to excite a seventh resonance mode and generate a radiation signal in a seventh frequency band;

a frequency of the first frequency band is less than a frequency of the fourth frequency band;

the frequency of the fourth frequency band is less than a frequency of the third frequency band;

the frequency of the third frequency band is less than a frequency of the second frequency band;

the frequency of the second frequency band is less than a frequency of the fifth frequency band;

a portion of a frequency of the sixth frequency band is between the frequency of the fourth frequency band and the frequency of the third frequency band, and a remaining portion of the frequency of the sixth frequency band overlaps with the frequency of the second frequency band;

a frequency of the seventh frequency band is greater than or equal to the frequency of the fifth frequency band.

20. The wireless communication device of claim 17, wherein:

the system ground surface comprises a switch comprising a movable contact, a first fixed contact, and a second fixed contact;

the movable contact is electrically coupled to the first radiating portion;

the first fixed contact is electrically coupled to the third radiating portion; and the second fixed contact is electrically coupled to the system ground surface;

the second fixed contact is electrically coupled to the system ground surface through a first matching component comprising a predetermined impedance;

the switch further comprises a third fixed contact;

the third fixed contact is electrically coupled to the system ground surface through a second matching component comprising a predetermined impedance;

the first matching component and the second matching component are electrically coupled to different points of the system ground surface.

* * * * *